US008739900B2

(12) United States Patent
Gregurek et al.

(10) Patent No.: US 8,739,900 B2
(45) Date of Patent: Jun. 3, 2014

(54) SYSTEM AND METHOD FOR COUPLING A DRILL BIT TO A WHIPSTOCK

(75) Inventors: Philip M. Gregurek, Pearland, TX (US); Shantanu N. Swadi, Cypress, TX (US); Charles H. Dewey, Houston, TX (US); Shelton W. Alsup, Houston, TX (US)

(73) Assignee: Smith International, Inc., Houston, TX (US)

( * ) Notice: Subject to any disclaimer, the term of this patent is extended or adjusted under 35 U.S.C. 154(b) by 155 days.

(21) Appl. No.: 13/440,708

(22) Filed: Apr. 5, 2012

(65) Prior Publication Data

US 2012/0255785 A1 Oct. 11, 2012

Related U.S. Application Data

(60) Provisional application No. 61/472,073, filed on Apr. 5, 2011.

(51) Int. Cl.
*E21B 7/08* (2006.01)

(52) U.S. Cl.
USPC ..... 175/79; 175/45; 166/117.5; 166/255.3; 166/377

(58) Field of Classification Search
USPC ..... 166/117.5, 298, 55; 175/79, 45
See application file for complete search history.

(56) References Cited

U.S. PATENT DOCUMENTS

| | | | | |
|---|---|---|---|---|
| 4,397,355 | A * | 8/1983 | McLamore | 166/297 |
| 5,806,596 | A | 9/1998 | Hardy et al. | |
| 5,826,651 | A * | 10/1998 | Lee et al. | 166/117.6 |
| 5,878,818 | A * | 3/1999 | Hebert et al. | 166/382 |
| 5,887,655 | A * | 3/1999 | Haugen et al. | 166/298 |
| 6,032,740 | A * | 3/2000 | Schnitker et al. | 166/298 |
| 6,089,319 | A | 7/2000 | Singleton | |
| 6,612,383 | B2 | 9/2003 | Desai et al. | |
| 6,719,045 | B2 | 4/2004 | Hart et al. | |
| 7,225,889 | B2 | 6/2007 | Dewey | |
| 7,267,175 | B2 | 9/2007 | Haugen et al. | |
| 7,610,971 | B2 | 11/2009 | Neff | |
| 2001/0035302 | A1 | 11/2001 | Desai et al. | |
| 2002/0195243 | A1 | 12/2002 | Hart et al. | |
| 2004/0089443 | A1 | 5/2004 | Dewey et al. | |
| 2004/0173384 | A1 | 9/2004 | Yong et al. | |

(Continued)

FOREIGN PATENT DOCUMENTS

WO 2006070204 7/2006

OTHER PUBLICATIONS

International Search Report and Written Opinion of PCT Application No. PCT/US2012/032389 dated Oct. 29, 2012: pp. 1-12.

(Continued)

*Primary Examiner* — Yong-Suk (Philip) Ro

(57) ABSTRACT

A system and method facilitate drilling of a lateral wellbore by eliminating one or more trips downhole. The system comprises a drill bit optimized for the drilling operation. The drill bit is coupled to a whipstock via a connector, which minimizes interference with the cutting elements of the drill bit. The connector includes a separation device which facilitates disconnection of the drill bit from the whipstock after the whipstock is anchored at a desired downhole location. The separation device is disposed in the connector to minimize the remaining portions of the connector existing after separation of the drill bit from the whipstock which must be milled by the drill bit prior to drilling the lateral wellbore.

20 Claims, 9 Drawing Sheets

(56) References Cited

U.S. PATENT DOCUMENTS

| | | | |
|---|---|---|---|
| 2005/0039905 | A1 | 2/2005 | Hart et al. |
| 2007/0044954 | A1 | 3/2007 | Dewey |
| 2008/0302575 | A1 | 12/2008 | Durairajan et al. |
| 2009/0133877 | A1 | 5/2009 | Neff |
| 2011/0155468 | A1 | 6/2011 | Gregurek et al. |
| 2012/0222902 | A1 | 9/2012 | Alsup et al. |
| 2012/0261193 | A1 | 10/2012 | Swadi et al. |

OTHER PUBLICATIONS

International Search Report and Written Opinion of PCT Application No. PCT/US2012/027322 dated Sep. 25, 2012: pp. 1-18.
International Search Report and Written Opinion of PCT Application No. PCT/US2012/033700 dated Jan. 14, 2013: pp. 1-12.
Dewey et al., "SPE 138001: High Performance Wellbore Departure and Drilling System for Accessing New Target," SPE International, 2011: pp. 1-9.

* cited by examiner

SYSTEM AND METHOD FOR COUPLING A DRILL BIT TO A WHIPSTOCK

CROSS-REFERENCE TO RELATED APPLICATION

The present document is based on and claims priority to U.S. Provisional Patent Application Ser. No. 61/472,073, filed on Apr. 5, 2011, the disclosure of which is incorporated by reference herein in its entirety.

BACKGROUND

Directional drilling has proven useful in facilitating production of formation fluid, e.g., hydrocarbon-based fluid, from a variety of reservoirs. In application, a vertical wellbore is drilled, and directional drilling is employed to create one or more deviated or lateral wellbores extending outwardly from the vertical wellbore. Often, a whipstock is employed to facilitate the drilling of lateral wellbores in a method referred to as sidetracking.

Whipstocks are designed with a face, or ramp surface, oriented to guide the drill bit in a lateral direction into the sidewall of the wellbore to establish a lateral or deviated wellbore, which branches from the existing vertical wellbore. The whipstock is positioned at a desired depth in the wellbore and oriented to facilitate directional drilling, i.e., sidetracking, of the lateral wellbore along the desired drill path. In many applications, sidetracking requires at least two trips downhole. In the initial trip, the whipstock is delivered downhole, oriented and set at the desired wellbore location. The second trip is used to deliver a bottomhole assembly with a conventional drill bit to drill the deviated secondary, lateral borehole. However, each trip downhole increases both the time and cost associated with the drilling operation.

SUMMARY

A system and method to facilitate the drilling of a lateral wellbore, e.g., by eliminating one or more trips downhole, is disclosed. In one or more embodiments, the system comprises a drill bit having cutting elements, supported by at least one cutting element support surface, to drill at least a partial lateral wellbore through the sidewall of a wellbore. The drill bit also includes an attachment end portion for coupling the drill bit to a drill string and a shank disposed between the at least one cutting element support surface and the attachment end portion. The drill bit may also include one or more junk channels disposed proximate the at least one cutting element support surface.

The system further comprises a whipstock having a face with a profile arranged and designed to guide the drill bit into the sidewall during the drilling of lateral wellbore. The system further comprises a connector, which couples the drill bit to the whipstock for deployment of the drill bit and whipstock into the wellbore. The connector includes a longitudinal member with two end portions, with one end portion coupling to the shank and the other end portion coupling to the whipstock. The longitudinal member is arranged and designed to extend between the shank and the whipstock and to be at least partially disposed in at least one junk channel of the drill bit. The connector also includes a separation device arranged and designed to separate the drill bit from the whipstock. The separation device is disposed in the longitudinal member at a position between an uppermost portion of the at least one cutting element support surface of the drill bit and the whipstock, such position selected to minimize any portion of the connector remaining after separation which must be milled prior to drilling the at least partial lateral wellbore through the sidewall of the wellbore.

A method of coupling a drill bit to a whipstock for deployment into a wellbore is also disclosed. One or more embodiments of such method include coupling the longitudinal member to the shank of the drill bit, disposing at least a portion of the longitudinal member in one or more junk channels of the drill bit and coupling the longitudinal member to a whipstock. A method of using one or more embodiments of the system is also disclosed.

This summary is provided to introduce a selection of concepts that are further described below in the detailed description. This summary is not intended to identify key or essential features of the claimed subject matter, nor is it intended to be used as an aid in limiting the scope of the claimed subject matter.

BRIEF DESCRIPTION OF THE DRAWINGS

Certain embodiments will hereafter be described with reference to the accompanying drawings, wherein like reference numerals denote like elements, and.

DETAILED DESCRIPTION

Figure 1:
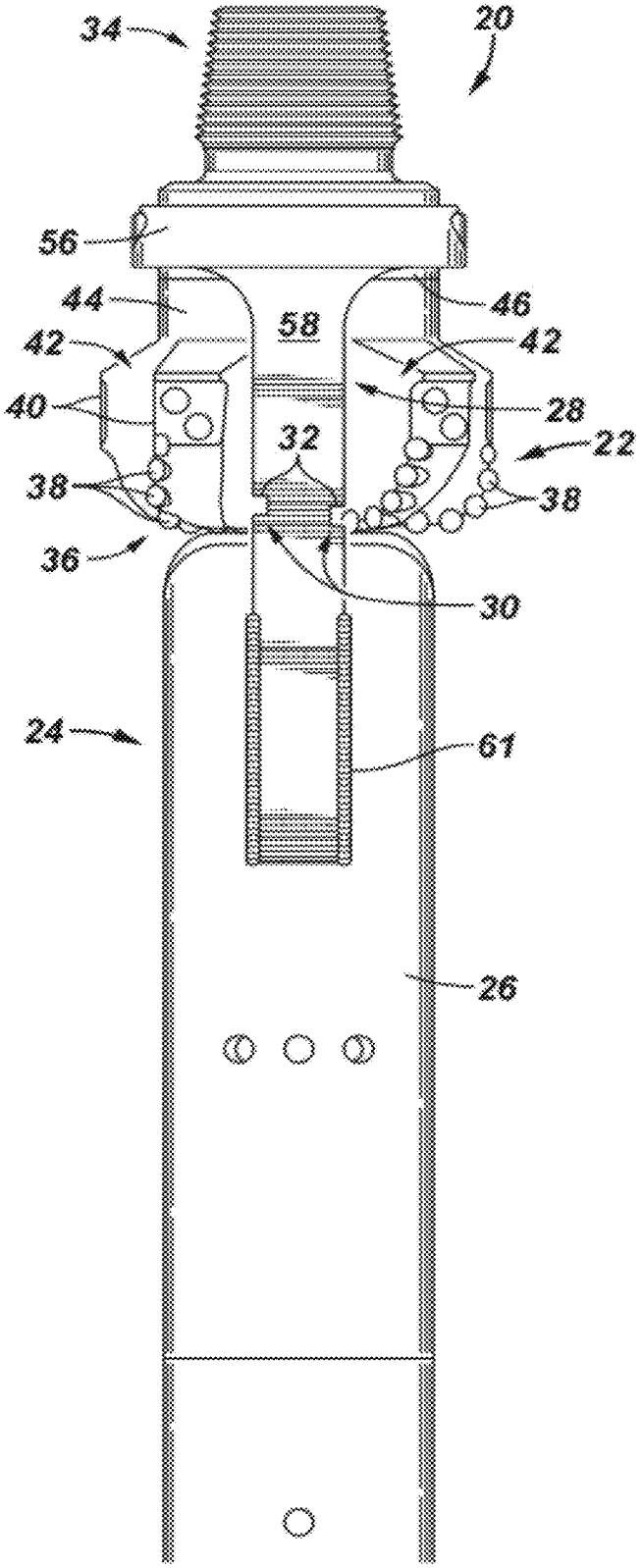
FIG. 1 is an illustration of one example of a lateral wellbore drilling system comprising a whipstock assembly coupled to a drill bit by a connector, according to an embodiment of the present disclosure.

In the following disclosure, numerous details are set forth to provide an understanding of the one or more embodiments of the invention. However, it will be understood by those of ordinary skill in the art that one or more embodiments of the invention may be practiced without these details and that numerous variations or modifications from the described embodiments may be possible.

The present disclosure generally relates to a system and method to facilitate the drilling of a lateral wellbore by eliminating one or more downhole trips by deploying a drill bit releasably coupled to a whipstock in a single downhole trip. The system combines a drill bit, e.g., a polycrystalline diamond compact (PDC) drill bit, with a whipstock assembly via a connector. The connector is designed for use with a variety of conventional PDC drill bits as well as other conventional drill bits. The connector also comprises a separation device/mechanism, which facilitates separation of the whipstock assembly from the drill bit once the whipstock assembly is positioned and anchored at a desired downhole location.

The connector is designed for use with specific drill bits, e.g., specific PDC drill bits, and such design is based on the blade count and corresponding junk slots/channels which can vary from one PDC bit to another. Because the connector is designed for the specific drill bit, changes to the cutting structures of the drill bit itself are not required. Thus, optimal cutting structures/geometries, as provided by state-of-the-art drill bits, may be selected for the drilling requirement, without regard to the connector. In one embodiment, the connector is relatively short and strong and is coupled to a shank/shank region of the drill bit. The connector may also be coupled to the breaker slots of a PDC drill bit, e.g., when the breaker slots are desirably oriented with respect to the drill bit.

In another embodiment, the connector is coupled to a bit sub, which is coupled to an upper end portion of the drill bit. The bit sub may be coupled, for example, via a threaded connection to an upper end portion of a PDC drill bit, and the connector may be coupled to the bit sub in any known manner to those skilled in the art. In this latter embodiment, the bit sub may have multiple holes therein to enable coupling of the connector at a variety of rotational orientations. This allows the connector to be indexed or positioned relative to the drill bit such that the connector extends down adjacent the cutting element support surfaces (i.e., blades) of the drill bit along a desired path, e.g., disposed in a junk slot/channel.

In the embodiments described above, the connector may be coupled to an upper end portion of a whipstock, which forms part of the whipstock assembly. For example, a lower end portion of the connector may be welded to an upper end portion of the whipstock. In one or more embodiments, the drill bit may be coupled to a bit motor or a turbine, e.g., via a threaded connection, prior to coupling of the connector.

The separation device/mechanism of the connector facilitates separation of upper and lower portions of the connector once the whipstock assembly is anchored or secured at the desired downhole location. In one or more embodiments, the connector may include a shear portion, which is designed to shear upon application of a predetermined loading/force to the connector. In such embodiments, the shear portion may comprise a shear device/mechanism, such as a groove or notch formed in a surface thereof or a shear bolt fastening two portions of the connector together. After shearing, an upper portion of the connector remains with the drill bit (i.e., within one or more junk channels between cutting element support surfaces/blades), which reduces the amount of shrapnel that would otherwise be milled by the drill bit during sidetracking.

Referring generally to FIG. 1, an embodiment of a lateral wellbore drilling system/assembly 20 is illustrated and comprises a drill bit 22 coupled to a whipstock assembly 24 having a whipstock 26. The drill bit 22 is coupled to the whipstock assembly 24 with a connector 28. The connector 28 comprises a longitudinal member 58 that extends between the drill bit 22 and the whipstock 26 of the whipstock assembly 24. The connector 28 also comprises a separation device/mechanism 30 arranged and designed to enable separation of the whipstock 26/whipstock assembly 24 from the drill bit 22 when the whipstock assembly 24 is positioned and anchored at a desired location within an openhole (i.e., non-cased portion of the wellbore). The separation device/mechanism 30 of connector 28 may comprise a shear device, such as a groove or notch 32, disposed in the longitudinal member 58 of the connector 28 to enable separation by shearing of the connector 28 into upper and lower portions upon application of a force or loading upon the connector 28, e.g., by pulling up on the drill string coupled to connector 28 after whipstock assembly 24 is anchored.

Lateral wellbore drilling system/assembly 20 may also comprise other components of a bottomhole assembly depending on the specifics of the drilling application. Examples of other bottomhole assembly components that may be coupled to the drill string above drill bit 22 include a motor, e.g., a mud motor, (not shown) designed to rotate the drill bit 22. A turbine (not shown) may also be equally employed to rotate drill bit 22. Directional drilling and measurement equipment may also be coupled to the drill string above drill bit 22. While not shown in FIG. 1, such directional drilling equipment may comprise a steerable drilling assembly which may include a bent angle housing to direct the angle of drilling (i.e., directionally control the drilling) during drilling of the lateral wellbore. The directional drilling equipment may alternatively employ other directional control systems including, but not limited to, push-the-bit or point-the-bit rotary steerable systems. A variety of other features and components also known to those skilled in the art may be incorporated into lateral wellbore drilling system/assembly 20, including measurement-while-drilling and logging-while-drilling equipment.

Depending on the specific sidetracking operation to be performed, the whipstock assembly 24 may comprise a variety of components to facilitate anchoring of the whipstock 26 and guiding of the drill bit 22 during drilling of a lateral wellbore. By way of example, the whipstock assembly 24 may comprise a setting assembly (not shown) which facilitates engagement with a sidewall of the wellbore (not shown) when locating the whipstock assembly 24 at a desired location within the wellbore. The setting assembly may utilize an anchor (not shown) having a relatively large ratio of expanded diameter to unexpanded diameter to facilitate engagement with the wellbore sidewall. The anchor may employ a plurality of slips which are expandable between a running position (unexpanded) and an anchoring position (expanded). In at least some applications, the slips are hydraulically set by directing high pressure, hydraulic actuating fluid along a suitable passageway 52 (FIG. 4) and/or conduit 76 in or along the drill bit 22 and/or whipstock 26. Other systems and methods known to those skilled in the art may be employed for setting whipstock assembly 24.

According to one embodiment, the lateral wellbore drilling system/assembly 20 is conveyed downhole to a desired location and rotated to the desired orientation in which to drill the lateral wellbore/borehole. Hydraulic fluid is then delivered downhole via passageway 52 (FIG. 4) and/or conduit 76 through the drill bit 22 and along the whipstock 26 to the anchor. The hydraulic fluid applies hydraulic pressure to set the anchor slips against the surrounding wellbore sidewall, thereby securing the whipstock 26 at the desired wellbore location and orientation. An upward force may then be applied to drill bit 22 (and coupled connector 28) via the drill string, or the drill bit may then be rotated or otherwise loaded to separate connector 28 at the separation device/mechanism 30. Upon separation from the whipstock 26, the drill bit 22 may be moved along a ramp portion or face of the whipstock 26, which is arranged and designed to guide the drill bit 22 into the sidewall of the openhole for drilling the lateral wellbore.

Figure 2:
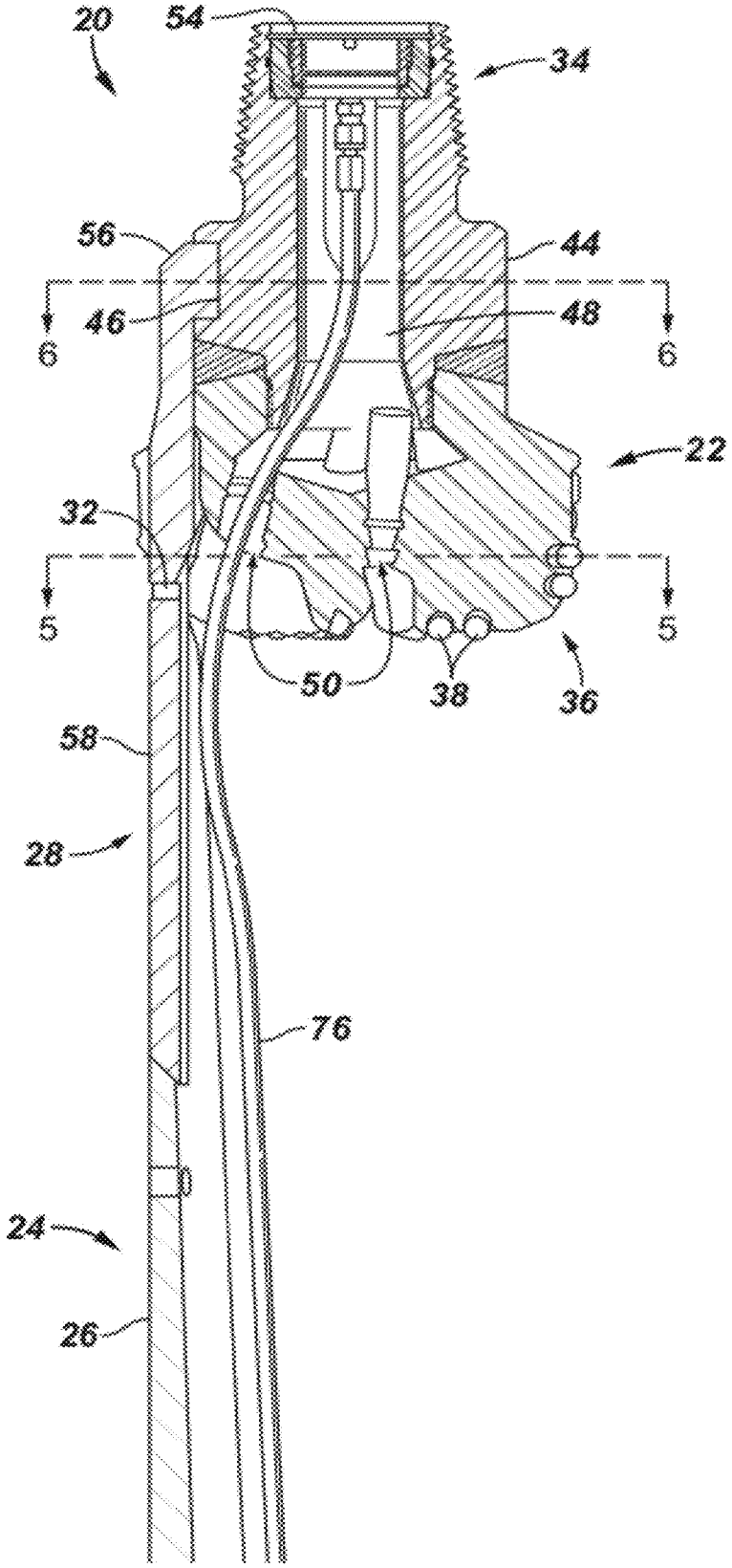
FIG. 2 is a cross-sectional view of the lateral wellbore drilling system illustrated in FIG. 1, according to an embodiment of the present disclosure.
Figure 3:
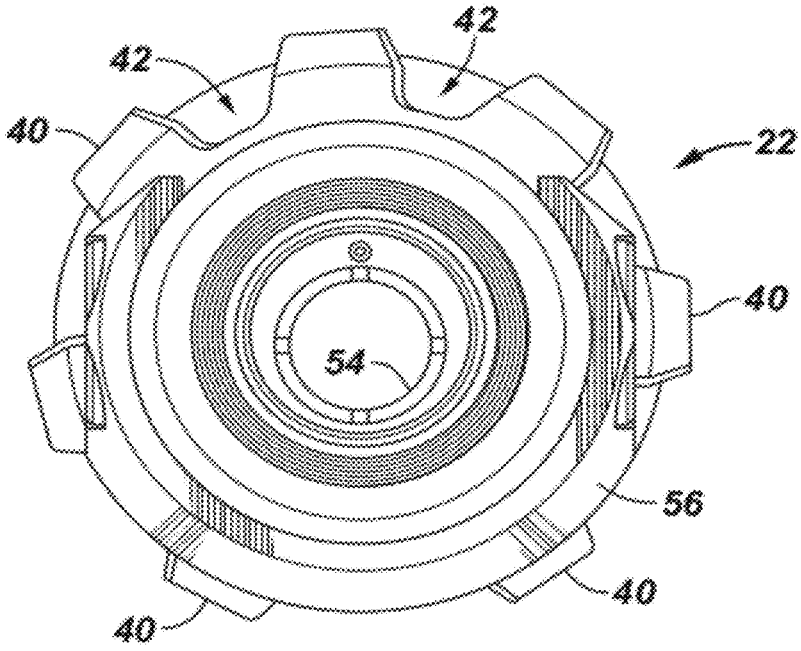
FIG. 3 is a top view of the drill bit positioned above the whipstock assembly, according to an embodiment of the present disclosure.
Figure 4:
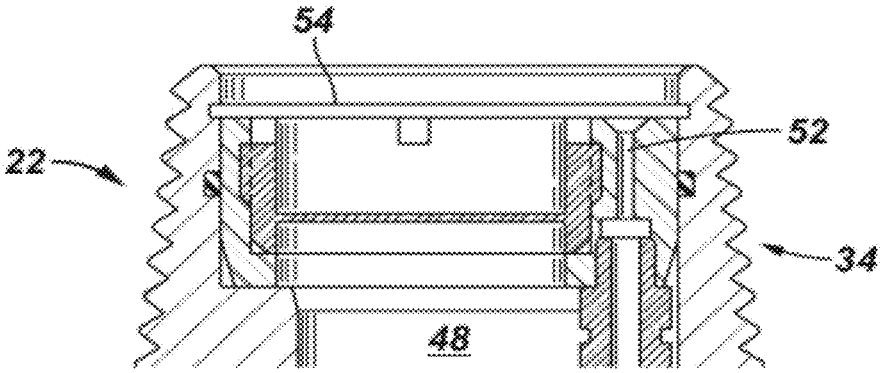
FIG. 4 is a detailed cross-sectional view of an upper end portion of the drill bit, according to an embodiment of the present disclosure.

With additional reference to FIGS. 2-4, drill bit 22 is illustrated as a PDC drill bit. In this embodiment, drill bit 22 comprises an attachment end portion 34 and a cutting end portion 36. The cutting end portion 36 comprises a plurality of cutters/cutting elements 38, such as polycrystalline diamond compact (PDC) cutters, arranged and designed to drill the lateral wellbore over a distance to target. As best illustrated in FIG. 1, cutters/cutting elements 38 are coupled, e.g., mounted, on cutting element/cutter support surfaces or blades 40, which are separated by junk channels 42. The drill bit 22 also has a shank region with a shank 44 located between attachment end portion 34 and cutting end portion 36. Returning to FIG. 2, the shank 44 comprises one or more breaker slots 46. Additionally, the drill bit 22 has a central, internal flow path 48 that directs drilling fluid downwardly therethrough and then out through nozzles 50 to facilitate removal of cuttings during drilling. In one or more embodiments, the drill bit 22 also may have one or more secondary flow passages 52 (see FIG. 4) and/or a conduit 76 (FIG. 2) through which hydraulic actuating fluid may be delivered downhole to actuate downhole tools, such as the anchor slips of the whipstock assembly 24.

Prior to the separation of drill bit 22 from the whipstock 26/whipstock assembly 24, the flow path 48 and/or secondary flow passage 52 may be blocked by one or more flow blockage members 54, such as a burst disc, as best illustrated in FIGS. 3 and 4. In one or more embodiments, separate burst discs may be arranged and designed to separately block flow path 48 and secondary flow passage 52, thereby enabling, e.g., actuation of the anchor slips prior to fluid flow through central flow path 48.

Figure 5:
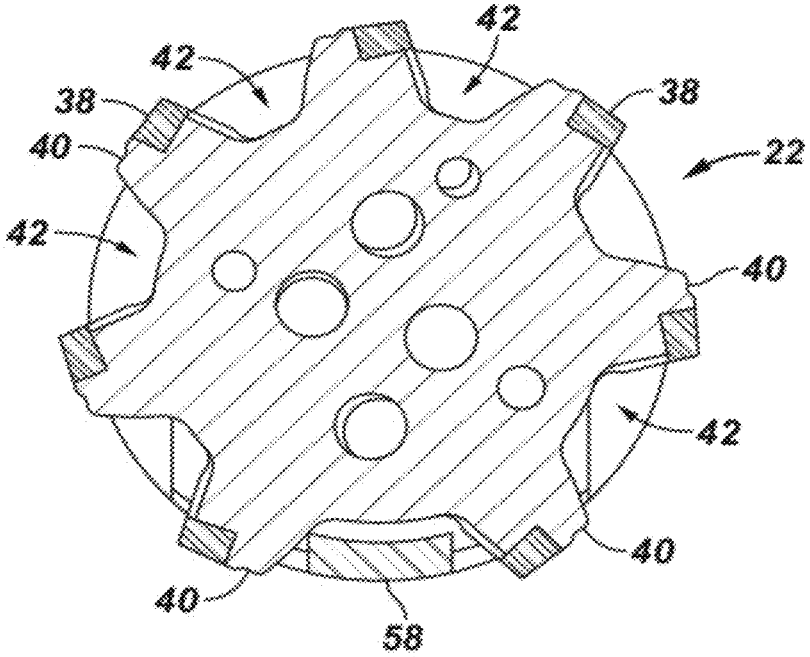
FIG. 5 is a cross-sectional view taken generally along line 5-5 of FIG. 2, according to an embodiment of the present disclosure.
Figure 6:
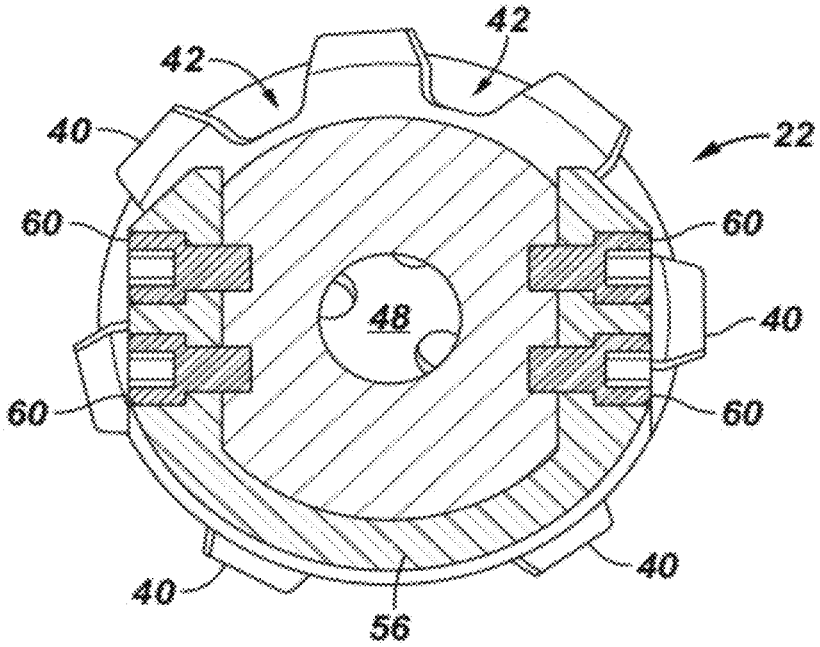
FIG. 6 is a cross-sectional view taken generally along line 6-6 of FIG. 2, according to an embodiment of the present disclosure.

Returning to FIG. 2, an upper end portion of connector 28 is shown coupled to drill bit 22 via a collar 56. By way of example, and not limitation, collar 56 may extend around a portion of the shank 44 of drill bit 22 for coupling therewith at a location/position which does not interfere with the existing cutter design/geometry of drill bit 22 (e.g., above an uppermost cutter/cutting element 38 or above a uppermost portion of cutting element/cutter support surface 40). As further illustrated in FIGS. 5-6, the collar 56 may be generally U-shaped and secured to drill bit 22 via suitable fasteners 60, such as bolts which extend through the collar 56 and into the shank region 44 of drill bit 22. In one embodiment, the fasteners 60 may secure collar 56 to the breaker slots 46 of drill bit 22. Those skilled in the art will readily recognize that a variety of fastener types may be used to secure connector 28 to the shank 44 of drill bit 22.

While being illustrated in this embodiment as extending around at least a portion of the circumference of drill bit 22, collar 56 may be any size or shape which permits connector 28 to couple to the drill bit 22. Collar 56 is arranged and designed such that longitudinal member 58 of connector 28 extends downwardly from the shank 44 of drill bit 22 to couple with whipstock 26. In one or more embodiments, at least a portion of the longitudinal member 58 is positioned between adjacent blades 40, e.g., in one or more junk slot/channels 42.

Returning to FIG. 2, the longitudinal member 58 includes a separation device/mechanism 30, which is disposed in the longitudinal member 58 and defines an upper portion of longitudinal member 58 above the separation device/mechanism 30 and a lower portion of longitudinal member 58 below the separation device/mechanism 30. After separation, e.g., the upper portion of the severed longitudinal member 58 remains coupled to the shank 44 of drill bit 22 and remains disposed at least partially in one or more junk slots/channels 42 such that the majority of this upper portion of the severed longitudinal member does not interfere with the cutting operation of cutting elements 38. Preferably, separation member 30 is disposed in longitudinal member 58 at a position which minimizes the upper and/or lower portions of the longitudinal member 50 which must be milled by cutting elements 38 after separation of drill bit 22 from whipstock 26 and prior to drilling at least a partial lateral wellbore in the openhole. In one or more embodiments, the separation device/mechanism 30 is disposed in the longitudinal member 58 between an upper end portion of the whipstock 26 and an uppermost portion of the cutting element/cutter support surface 40 (or an uppermost cutter/cutting element 38 positioned on the drill bit 22). As illustrated in FIG. 2, the separation device/mechanism 30 is disposed in the longitudinal member 58 of connector 28 proximate the top end portion of the whipstock 26 (or the lower end portion of the cutting end portion 36 of drill bit 22).

As shown in FIGS. 1 and 2, the lower end portion of connector 28 may be coupled to whipstock 26 in any known manner to those skilled in the art. By way of example, and not limitation, the lower end portion of longitudinal member 58 of connector 28 may be secured to an upper end portion of whipstock 26 (e.g., the back of whipstock 26) by a suitable fastener 61. In another example, the lower end portion of longitudinal member 58 may be welded to the upper end portion of whipstock 26 (e.g., the back of whipstock 26), such that the weldment serves as fastener 61.

Figure 7:
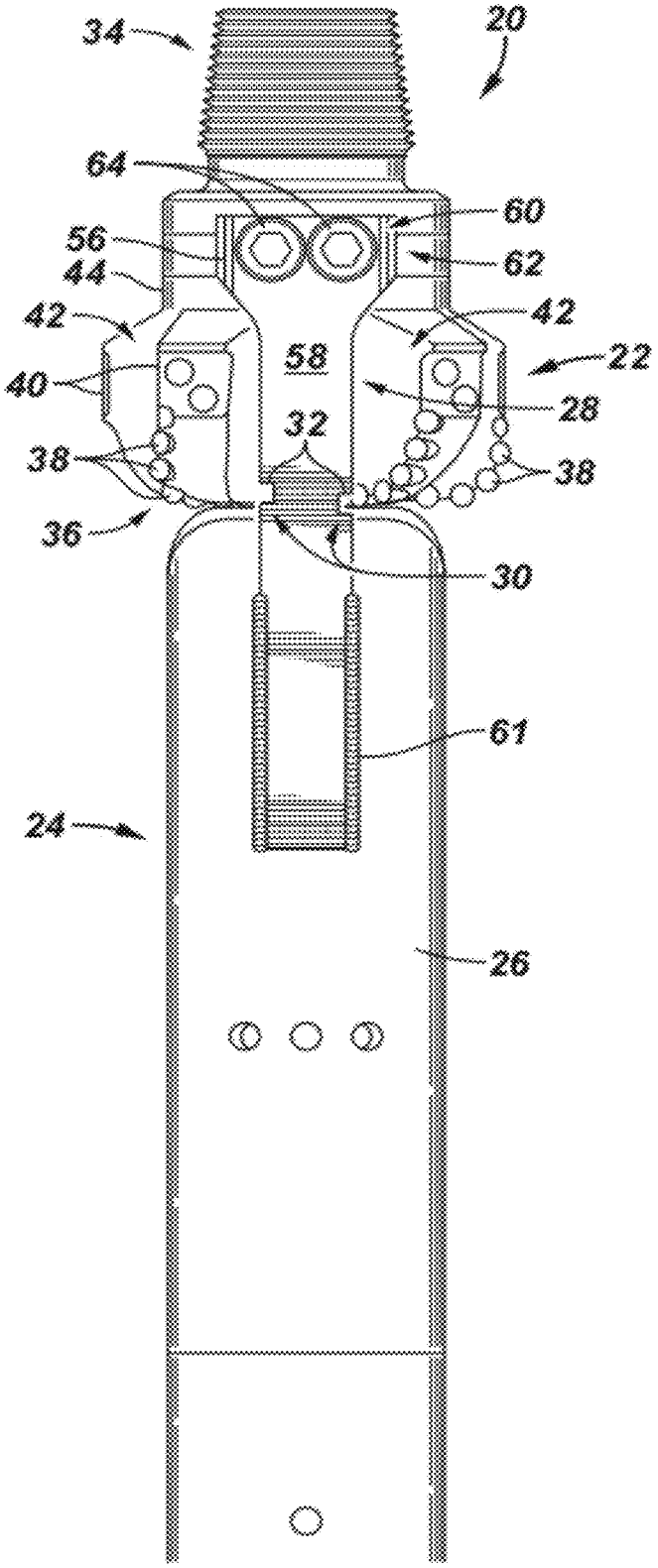
FIG. 7 is another example of the lateral wellbore drilling system, according to an alternative embodiment of the present disclosure.
Figure 8:
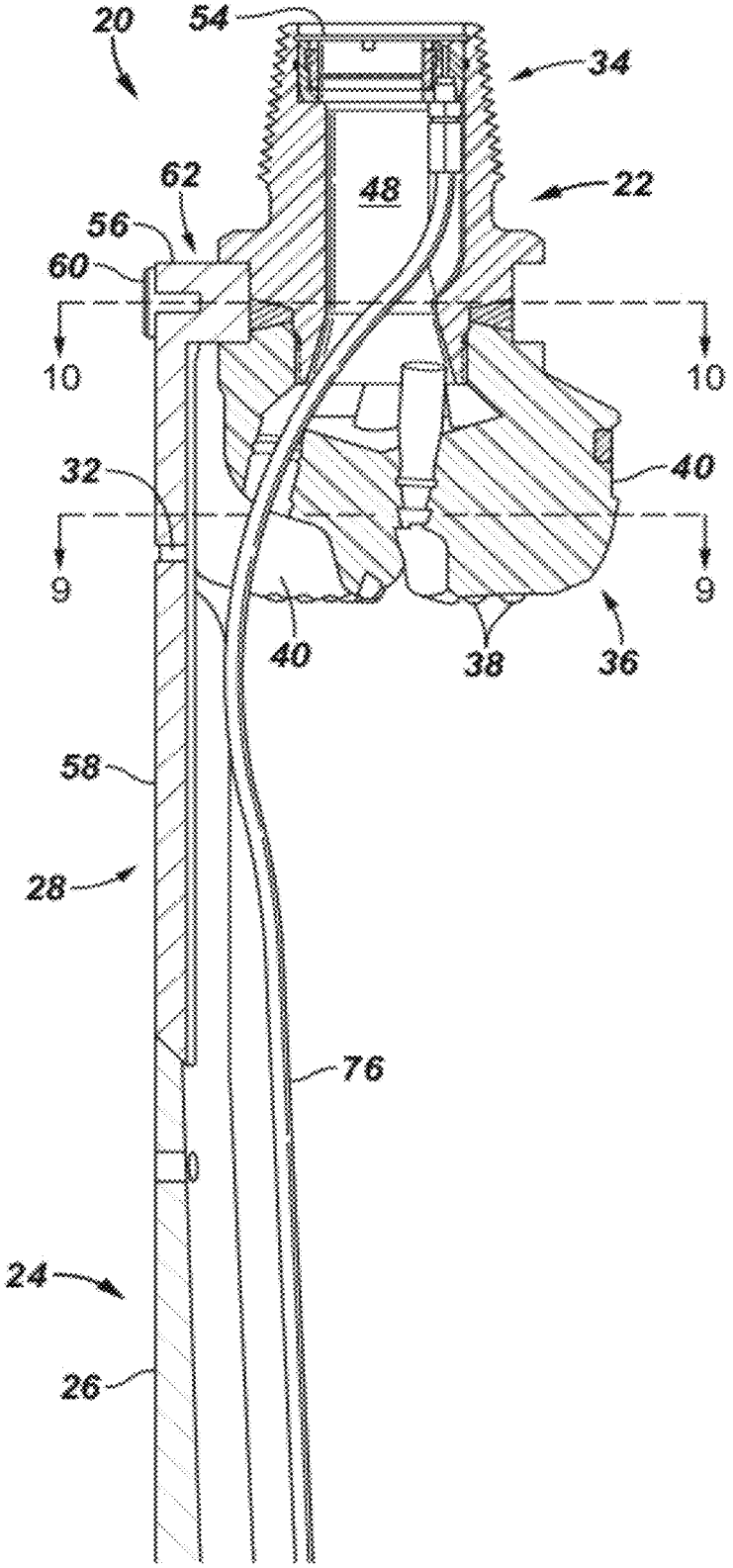
FIG. 8 is a cross-sectional view of the lateral wellbore drilling system illustrated in FIG. 7, according to an embodiment of the present disclosure.
Figure 9:
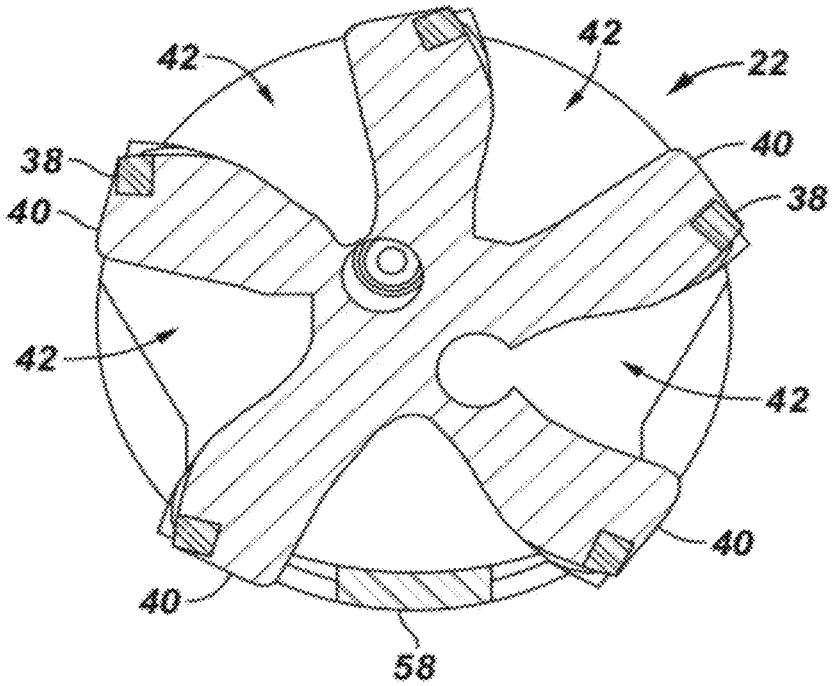
FIG. 9 is a cross-sectional view taken generally along line 9-9 of FIG. 8, according to an embodiment of the present disclosure.
Figure 10:
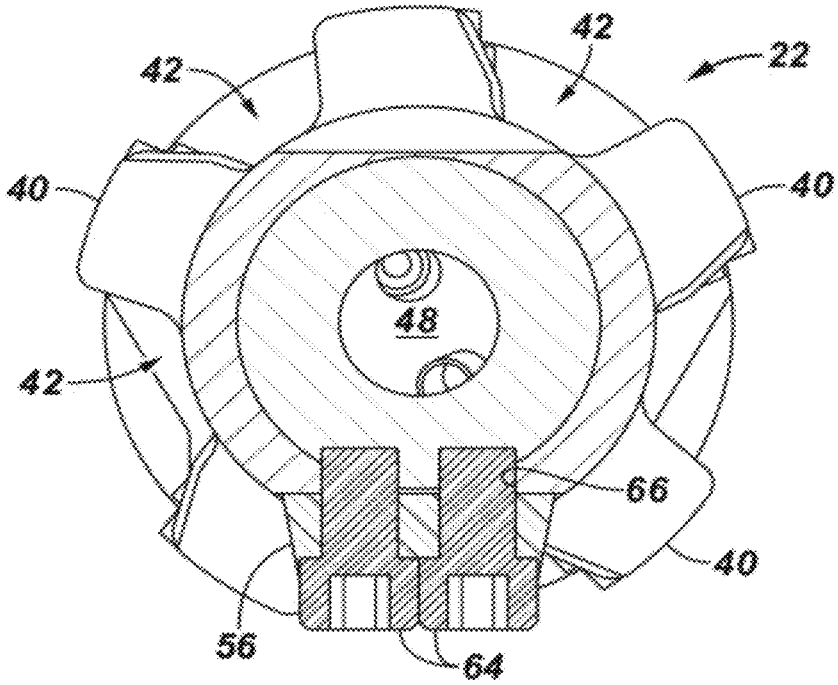
FIG. 10 is a cross-sectional view taken generally along line 10-10 of FIG. 8, according to an embodiment of the present disclosure.

In FIGS. 7-10, another embodiment of system/assembly 20 for coupling drill bit 22 to whipstock 26 is illustrated. In this embodiment, the collar 56 of connector 28 is in the form of an upper attachment member 62 positioned and coupled only on one side of the drill bit 22 (i.e., collar 56 does not wrap around a majority of the circumference of shank 44 of drill bit 22). As best illustrated in FIGS. 7-8, the upper attachment member 62 is coupled to shank 44 to enable positioning of longitudinal member 58 between adjacent blades 40 (see also FIG. 9). The upper attachment member 62 may be secured to the drill bit 22 by appropriate fasteners 60, such as the illustrated pair of bolts 64. Bolts 64 extend through upper attachment member 62 and into corresponding threaded apertures 66 (FIG. 10) of drill bit 22. As may be discerned from FIG. 10, the threaded apertures 66 may be arranged and designed to enable adjustability with respect the positioning of the connector 28.

Figure 11:
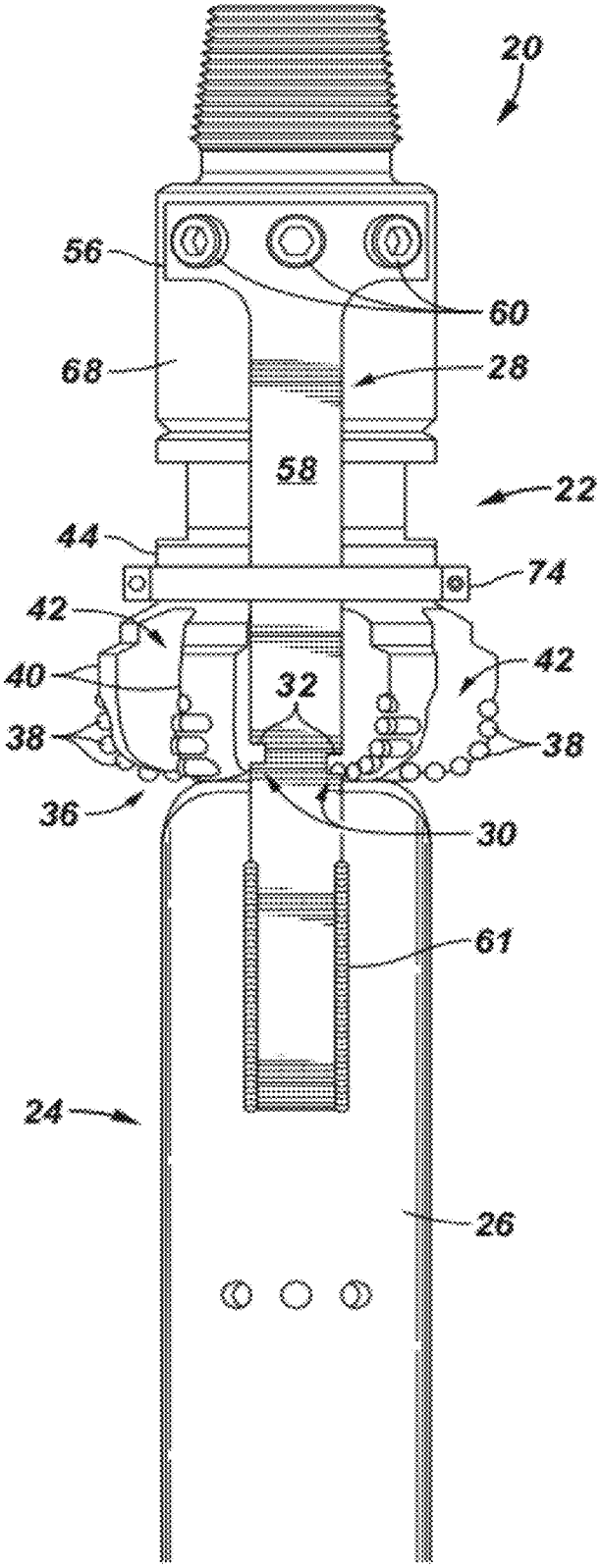
FIG. 11 is another example of a lateral wellbore drilling system, according to an alternative embodiment of the present disclosure.
Figure 12:
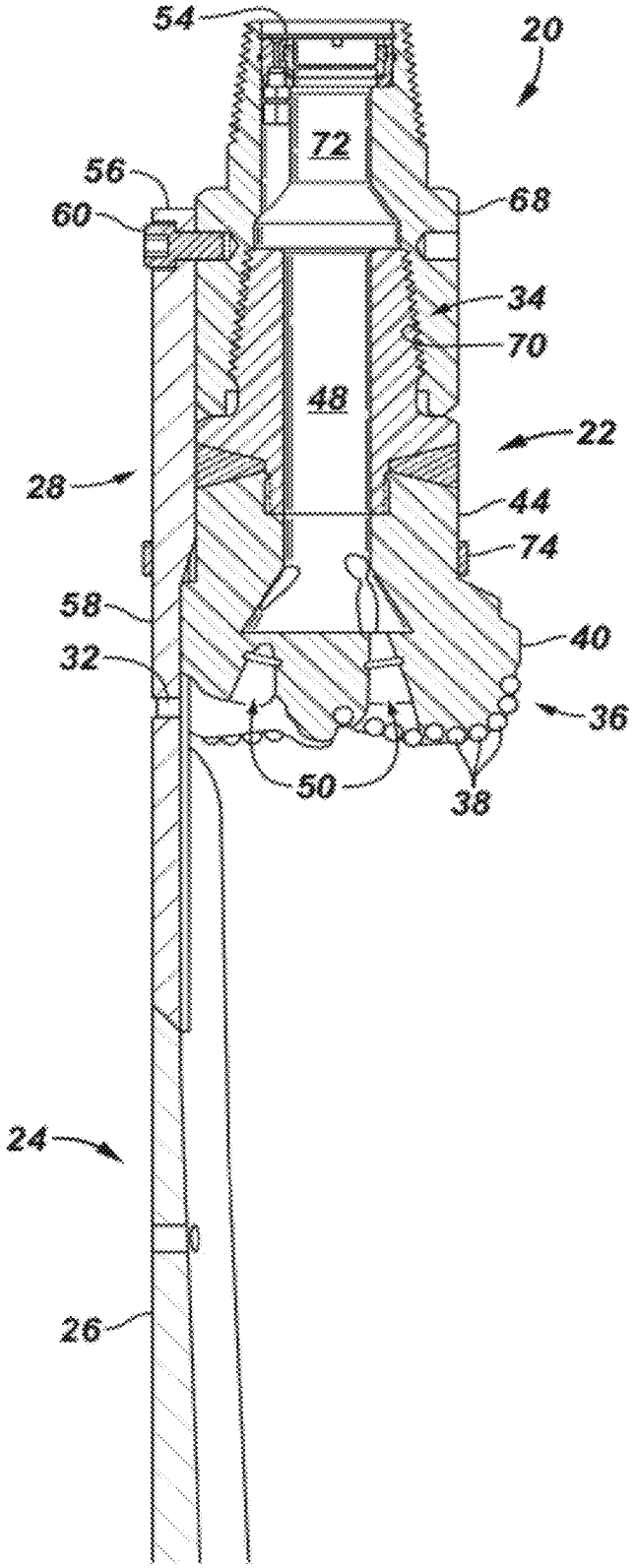
FIG. 12 is a cross-sectional view of the lateral wellbore drilling system illustrated in FIG. 11, according to an embodiment of the present disclosure.

Referring generally to FIGS. 11 and 12, another embodiment of lateral wellbore drilling system/assembly 20 is illustrated. In this embodiment, the collar 56 of connector 28 (shown similar in form to the upper attachment member 62 of FIGS. 7-8) is coupled to a bit sub 68. The bit sub 68 is generally a short sub which may be threadedly coupled to attachment end portion 34 of drill bit 22 via a threaded engagement region 70 (FIG. 12). As best illustrated in FIG. 12, the bit sub 68 has an internal flow passage 72, which directs drilling fluid flow to the internal flow path 48 of drill bit 22. If flow blockage members 54, e.g., rupture discs, are employed, they may be positioned at an upper end portion of the sub 68, as illustrated in FIG. 12.

In this latter embodiment, the connector 28 may be coupled to bit sub 68 via collar 56 and fasteners 60 or by other suitable coupling devices. The fasteners 60 may comprise bolts which can engage a variety of apertures to enable coupling of connector 28 at desired rotational orientations with respect to the drill bit 22 and the bit sub 68. The lower end portion of the connector 28 (i.e., a lower end portion of longitudinal member 58) may be coupled to an upper end portion of the whipstock 26 by one or more appropriate fasteners 61, as previously disclosed. In one embodiment, for example, the connector 28 may be welded to the upper end portion of whipstock 26. As illustrated, the separation device/mechanism 30 is positioned at or above the top end portion of whipstock 26. As with the previous embodiments, separation mechanism 30 is preferably disposed in longitudinal member 58 at a position which minimizes the portions of the longitudinal member 50 that remain exposed to milling upon separation. Due to the greater distance between bit sub 68 and whipstock 26, the longitudinal member 58 of connector 28 must be of greater length, and therefore, may be secured to drill bit 22 by a brace 74. By way of example, and not limitation, brace 74 may comprise a clamping band positioned around the longitudinal member 58 and the drill bit 22 at the shank 44 of drill bit 22.

Referring back to FIGS. 1 and 2, in a method of the disclosure, the lateral wellbore drilling system/assembly 20 (with drill bit motor locked) is tripped downhole with the drill bit 22 secured/coupled to the whipstock assembly 24 via connector 28. Once at the desired wellbore location, the whipstock 26 is oriented. The whipstock 26 may be oriented, e.g., with the aid of a measurement-while-drilling/gyro system. The whipstock 26 is then set by anchoring the whipstock assembly 24 via, e.g., an expandable slip style anchor, as previously disclosed. After setting the whipstock 26, the drill bit 22 is sheared from the whipstock assembly 24 via the separation device/mechanism 30 e.g., by applying an upward force on the drill string and drill bit 22. The drill bit motor may then be unlocked, and a bent housing of the drilling assembly may be oriented to point the drill bit 22 away from the whip face of the whipstock 26. The drill bit 22 is then operated to perform the directional drilling, i.e., sidetracking, operation in which a lateral wellbore is formed along a desired path to a target destination.

In this disclosure, several embodiments have been described in detail. However, those skilled in the art will readily appreciate that modifications are possible without materially departing from the teachings of this disclosure. Accordingly, such modifications are intended to be included within the scope of disclosure.

What is claimed is:

1. A drilling assembly for facilitating drilling of a lateral wellbore, the drilling assembly comprising:

a drill bit having cutting elements arranged and designed to drill at least a partial lateral wellbore through a sidewall of a wellbore, the cutting elements being supported by at least one cutting element support surface, the drill bit also having a junk channel disposed proximate the at least one cutting element support surface, an attachment end portion for coupling the drill bit to a drill string, and a shank disposed between the at least one cutting element support surface and the attachment end portion;

a whipstock having a face with a profile arranged and designed to guide the drill hit into the sidewall during drilling of the at least partial lateral wellbore, the whipstock also having a top end portion and a back which is opposite the face; and a connector coupling the drill bit to the whipstock for deployment of the drill bit and whipstock into the wellbore, the connector including a longitudinal member with two end portions, one end portion coupling to the shank and the other end portion coupling to the back of the whipstock, the longitudinal member arranged and designed to extend between the shank and the whipstock and to be at least partially disposed in the junk channel of the drill bit, the connector also including a separation device arranged and designed to separate the drill bit from the whipstock, the separation device being disposed in the longitudinal member at a position between an uppermost portion of the at least one cutting element support surface and the whipstock, the position selected to minimize any portion of the connector remaining after separation which must be milled prior to drilling the at least partial lateral wellbore through the sidewall of the wellbore.

2. The drilling assembly as recited in claim 1, wherein the cutting elements include at least one polycrystalline diamond cutter.

3. The drilling assembly as recited in claim 1, wherein the one end portion of the longitudinal member of the connector couples to the shank via a collar.

4. The drilling assembly as recited in claim 3, wherein the collar is at least partially disposed in a breaker slot of the shank.

5. The drilling assembly as recited in claim 1, wherein the one end portion of the longitudinal member of the connector is fastened to the shank of the drill bit.

6. The drilling assembly as recited in claim 1, wherein the other end portion of the longitudinal member of the connector is coupled to the back of the whipstock via a weld.

7. The drilling assembly as recited in claim 1, wherein the longitudinal member is disposed in the junk channel of the drill bit such that the longitudinal member disposed therein does not interfere with drilling operation of the cutting elements of the drill bit after the separation of the drill bit from the whipstock.

8. A system for drilling of a lateral wellbore, the system comprising:

a drill bit having cutting elements arranged and designed to drill at least a partial lateral wellbore through a sidewall of a wellbore and an attachment end portion for coupling to a drill string, the drill bit also having a junk channel;

a whipstock having a face with a profile arranged and designed to guide the drill bit into the sidewall during drilling of the at least partial lateral wellbore; and a longitudinal member coupling the drill bit to the whipstock, the longitudinal member being disposed in at least a portion of the junk channel, the longitudinal member having a shear device to facilitate separation of the drill bit from the whipstock, the shear device disposed along the longitudinal member at a position proximate a top end portion of the whipstock.

9. The system as recited in claim 8, wherein the cutting elements include at least one polycrystalline diamond cutter.

10. The system as recited in claim 8, Wherein the longitudinal member couples to a shank of the drill bit.

11. The system as recited in claim 8, wherein the longitudinal member couples to the drill bit via a collar.

12. The system as recited in claim 11, wherein the collar is at least partially disposed in a breaker slot of the drill bit.

13. The system as recited in claim 8, wherein the shear device is a notch in the longitudinal member.

14. The system as recited in claim 8, wherein the longitudinal member couples to the drill bit via a bit sub coupled to the drill bit.

15. The system as recited in claim 8, wherein the longitudinal member is coupled to the drill bit via a fastener.

16. The system as recited in claim 8, wherein the longitudinal member is coupled to the whipstock via a weld.

17. The system as recited in claim 8, wherein the longitudinal member is disposed in the junk channel of the drill bit such that the longitudinal member disposed therein does not interfere with drilling operation of the cutting elements of the drill bit after the separation of the drill bit from the whipstock.

18. The system as recited in claim 8, wherein the shear device is disposed along the longitudinal member at a position between an uppermost cutting element and the whipstock to minimize any portion of the longitudinal member remaining after separation which must be milled prior to drilling the at least partial lateral wellbore through the sidewall of the wellbore.

19. A method of coupling a drill bit to a whipstock for deployment into a wellbore, the method comprising:

coupling a longitudinal member to a shank of a drill bit, the drill bit having cutters arranged and designed to drill at least a partial lateral wellbore through a sidewall of a wellbore, the cutters supported on at least one cutter support surface, the drill bit also having a junk slot disposed proximate the at least one cutter support surface and an attachment end portion for coupling to a drill string;

disposing at least a portion of the longitudinal member in the junk slot of the drill bit; and coupling, the longitudinal member to a whipstock, the whipstock having a face with a profile arranged and designed to guide the drill bit into the sidewall during drilling of the at least partial lateral wellbore, the longitudinal member having a shear device to facilitate separation of the drill bit from the whipstock, the shear device disposed along the longitudinal member at a position between an uppermost cutter positioned on the drill bit and the whipstock.

20. The method of claim 19, wherein the longitudinal member is disposed in the junk channel of the drill bit such that the longitudinal member disposed therein does not interfere with drilling operation of the cutters of the drill bit after the separation of the drill bit from the whipstock.

* * * * *